US005676887A

United States Patent [19]

Soeda et al.

[11] Patent Number: 5,676,887

[45] Date of Patent: Oct. 14, 1997

[54] FLOATLESS CARBURETOR

[75] Inventors: Isamu Soeda, Kanagawa, Japan; Michihiko Aoshima, Schaumburg, Ill.

[73] Assignee: Mikuni Corporation, Japan

[21] Appl. No.: 665,645

[22] Filed: Jun. 18, 1996

[30] Foreign Application Priority Data

Sep. 27, 1995 [JP] Japan ..... 7-249303

[51] Int. Cl.[6] ..... F02M 17/04

[52] U.S. Cl. ..... 261/35; 261/DIG. 50; 261/DIG. 68

[58] Field of Search ..... 261/35, DIG. 50, 261/DIG. 68

[56] References Cited

U.S. PATENT DOCUMENTS

| | | | |
|---|---|---|---|
| 3,441,010 | 4/1969 | Barr et al. | 261/DIG. 68 |
| 4,041,172 | 8/1977 | Nakamura et al. | 261/DIG. 50 |
| 4,159,012 | 6/1979 | Pizzuto et al. | 261/DIG. 68 |
| 4,160,425 | 7/1979 | Curtis | 261/DIG. 68 |
| 4,294,779 | 10/1981 | Alape | 261/DIG. 68 |

*Primary Examiner*—Tim R. Miles
*Attorney, Agent, or Firm*—Lorusso & Loud

[57] ABSTRACT

An orifice assembly is detachably attached to a cover serving as a wall surface of an atmospheric chamber. The orifice assembly includes two inner and outer communication ports in a housing thereof. The two inner and outer communication ports are shut out by a partition wall through which an orifice having a small diameter and a communication hole having a diameter larger than that of said orifice, and a check valve is disposed in the communication hole to close the latter therewith. One of the two inner and outer communication ports is communicated with an atmospheric chamber and the other inner and outer communication ports is communicated with the atmosphere. When the pressure in the atmospheric chamber becomes higher than the atmospheric pressure, the communication hole is closed with the check valve, and when the pressure in the atmospheric chamber 48 is equal to or becomes lower than the atmospheric pressure, the communication hole is opened.

4 Claims, 2 Drawing Sheets

FLOATLESS CARBURETOR

BACKGROUND OF THE INVENTION

The present invention relates to a floatless carburetor including no float chamber wherein fuel is ejected into a suction passage by actuation of a diaphragm.

A floatless carburetor of the foregoing type including no float chamber has been hitherto used as a carburetor for a personal water craft or the like usable as a leisure article on sea or lake.

To facilitate understanding of the present invention, the structure of a conventional floatless carburetor will be described below with reference to FIG. 2. A suction passage is formed in the interior of a housing 10 of the carburetor, and a throttle valve 14 is turnably arranged at the intermediate position of the suction passage 12. The housing 10 of the carburetor is provided with pumping means 18 for feeding fuel to a fuel feeding chamber 16 formed in the housing 10. The pumping means 18 includes a diaphragm 20, a fuel pump chamber 22 formed on one side of the diaphragm 20 and a pulse chamber 24 formed on the other side of the same. One part of the fuel pump chamber 22 is communicated with a fuel tank 26, while the other part of the same is communicated with the fuel feeding chamber 16. For example, pressure of a crank chamber 28 of an engine (alternating pressure comprising positive pressure and negative pressure) is introduced into the pulse chamber 24. As the pressure of the crank chamber 28 varies, the diaphragm 20 is actuated so that fuel is fed to the fuel feeding chamber 16 from the fuel tank 26 via the fuel pump chamber 22.

The fuel introduced into the fuel feeding chamber 16 is filtered by a filter 30 by the pressure of the fuel delivered from the pumping means 18 so that it is introduced a starting well 32. The fuel which has entered the starting well 32 opens a needle valve 34 by the pressure of the fuel by the pumping means 18 and is then introduced into a fuel regulating chamber 38 of which one wall is constituted by a main diaphragm 36.

An arm 42 which is contoured such that it is vertically projected on the both sides of a shaft 40 while it is turnable about the shaft 40 is disposed in the fuel regulating chamber 38. One fore end of the arm 42 comes in contact with a contact member 44 attached to the main diaphragm 36, and the other fore end of the arm 42 comes in contact with the needle valve 34. One end of a spring 46 comes in contact with the intermediate part of the arm 42 so that the arm 42 is normally biased by the spring 46 in a predetermined direction. Namely, the needle valve 34 is normally biased by the spring 46 in such a direction that it normally sits on a valve seat of the needle valve 34.

An atmospheric chamber 48 is provided on the opposite side to the fuel regulating chamber 38 while the main diaphragm 36 is interposed there between. A venting hole 52 is formed through a cover 50 defining the atmospheric chamber 48 so that the atmosphere chamber 48 is communicated with the atmosphere via the venting hole 62.

The fuel regulating chamber 38 is communicated with a main nozzle 56 via a main fuel passage 54, and the main nozzle 56 is opened to a Venturi portion 58 of the suction passage 12. The fuel regulating chamber 38 is communicated with a pilot fuel passage 64 which leads to a bypass hole 60 serving as a throw system outlet port as well as a pilot fuel outlet 62, and the bypass hole 60 and the pilot outlet 62 are opened to the suction passage 12 at the position located opposite to the position where the throttle valve 14 rotates.

A main jet 66 is provided at the intermediate part of the main fuel passage 54, and a pilot jet 68 is provided at the intermediate part of the pilot fuel passage 64. A check valve 70 for preventing air from reversely flowing from the main fuel passage 54 to the fuel regulating chamber 38 and the pilot fuel passage 64 is disposed on the fuel regulating chamber 38 side of the main fuel passage 54. Fuel in the fuel regulating chamber 38 is ejected in the suction passage 12 via the main nozzle 56 and the throw system outlet port.

After the fuel is ejected from the fuel regulating chamber 38, pressure balance is established among the pressure in the fuel regulating chamber 38 having a quantity of fuel reduced therein, the pressure in the atmospheric chamber 48 and the fuel pressure in a starting well 32 extending from the pumping means 18 to the needle valve 34, whereby the fuel from the starting well 32 is introduced into the fuel regulating chamber 38.

Generally, the housing 10 of the carburetor is mounted on a personal water craft of the like such that the suction passage 2 as shown in FIG. 2 is oriented in the vertical direction. In the case that the personal water craft quickly turns in the leftward direction while the suction passage 12 is mounted in the vertical direction (i.e., the state as shown in FIG. 2), gravity force is exerted on the housing 12 in the transverse direction at the time of quick turn of the personal water craft in the leftward direction. This causes the main diaphragm 36 to be thrusted toward the atmospheric chamber 48 side under the influence of the gravity force of the fuel stored in the fuel regulating chamber 38. A volume of air equal to the reduction of the volume of the atmospheric chamber 48 is easily discharged to the outside via the venting hole 52. Thus, the lower end of the arm 42 is parted away from the contact member 44 attached to the main diaphragm 36, causing the spring 46 to turn the arm 42 in the anticlockwise directiion so that the needle valve 34 sits on the valve seat, resulting in no fuel being introduced into the fuel regulating chamber 38. As a result, a quantity of fuel required by the engine can not be stored in the fuel regulating chamber 38 at the time of acceleration after the quick turn of the personal water craft. This leads to a malfunction that acceleration properties of the engine are degraded.

SUMMARY OF THE INVENTION

The present invention has been made in consideration of the aforementioned drawback An object of the present invention is to provide a floatless carburetor which assures that excellent acceleration properties of the engine are maintained during acceleration of the engine after completion of quick turn of a personal water craft or the like.

To accomplish the above object, the present invention provides a floatless carburetor including a fuel regulating chamber defined by a main diaphragm and an atmospheric chamber leading to the atmosphere for feeding fuel in a suction passage via the fuel regulating chamber by delivering fuel to the fuel regulating chamber by pumping means, wherein the floatless carburetor includes an orifice having a small diameter and an opening/closing communication hole having a diameter larger than that of the orifice between the atmospheric chamber and the atmosphere in the parallel relationship, and moreover, includes a check valve adapted to close the communication hole when the pressure in the atmospheric chamber becomes higher than the atmospheric pressure.

An orifice assembly is detachably attached to a cover serving as a wall surface of the atmosphere chamber and includes two inner and outer communication ports for making communication between the interior and the exterior of a housing thereof. In addition, the orifice assembly includes a partition wall in the housing for separating the two inner and outer communication ports from each other.

When the orifice assembly is attached to the cover, one of the two inner and outer communication ports is communicated with the atmospheric chamber and the other inner and outer communication port is communicated with the atmosphere.

The orifice and the communication hole are formed through the partition wall, and a check valve is disposed in the communication hole to open and close the latter.

DESCRIPTION OF THE PREFERRED EMBODIMENT

The present invention will be described in detail with reference to FIG. 1 which illustrates a preferred embodiment thereof.

Figure 1:
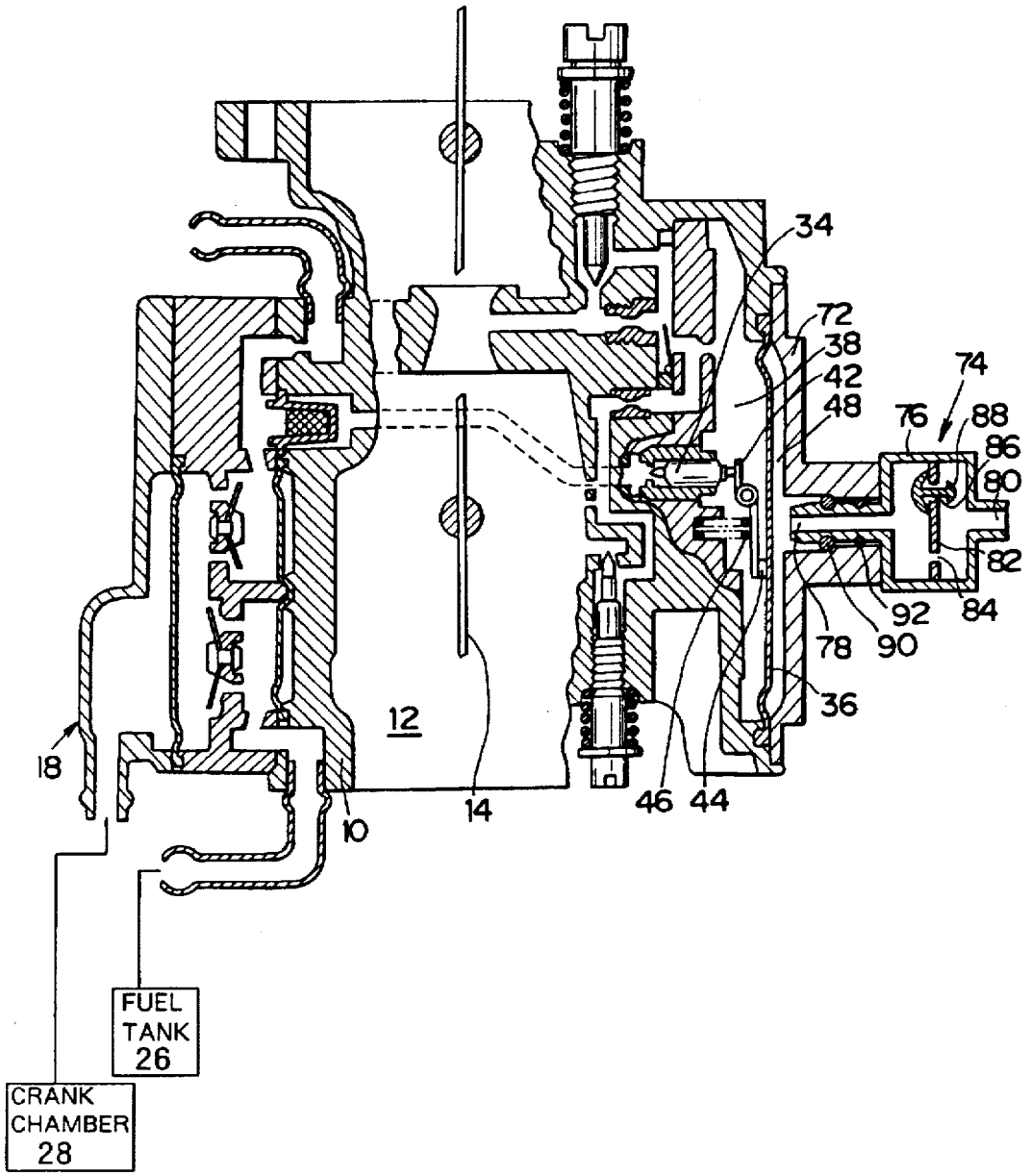
FIG. 1 is a sectional view of a floatless carburetor constructed according to an embodiment of the present invention.
Figure 2:
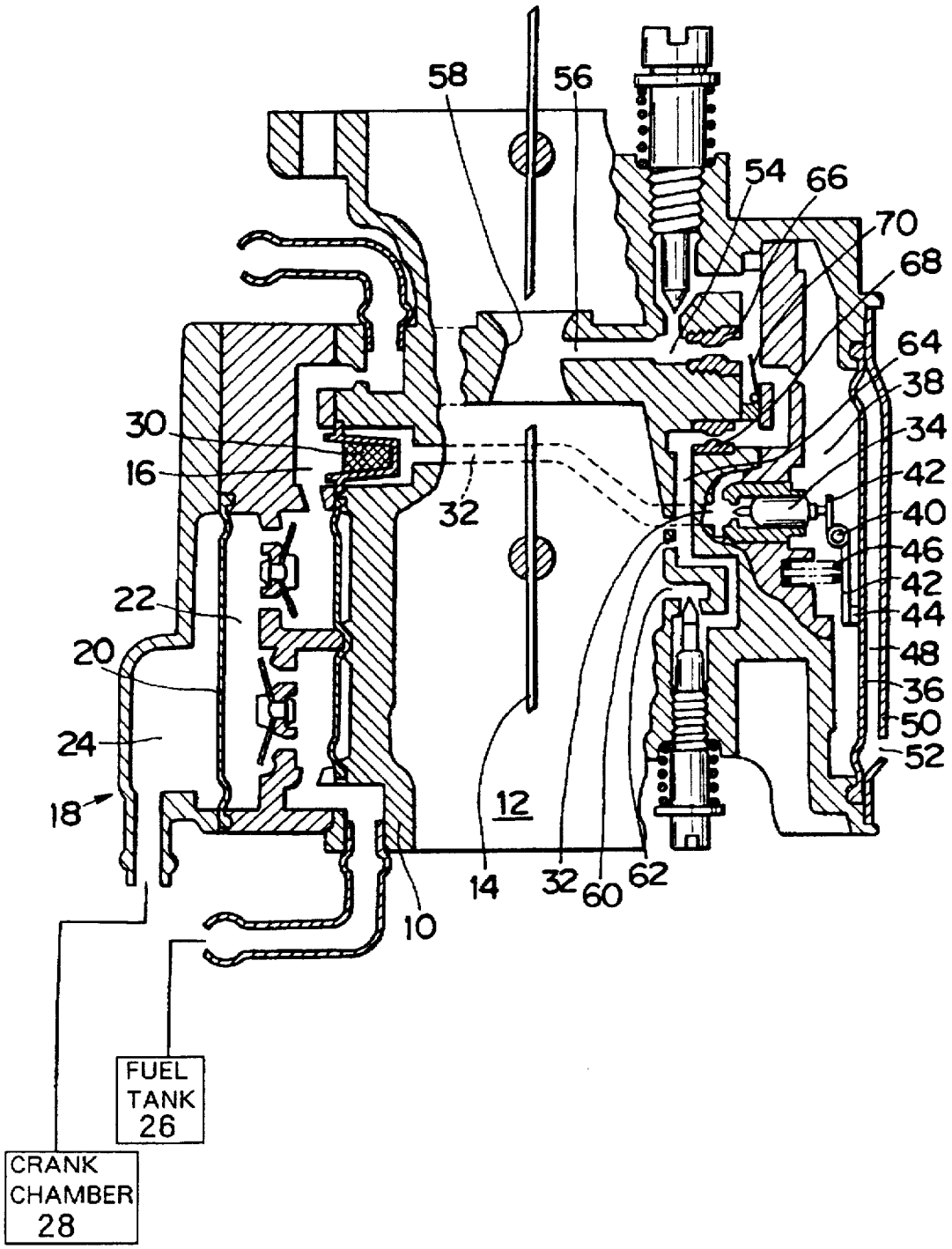
FIG. 2 is a sectional view of a conventional floatless carburetor.

FIG. 1 is a sectional view of a floatless carburetor constructed according to the embodiment of the present invention. Same components as those shown in FIG. 2 are represented by same reference numerals.

An orifice assembly 74 is attached to a cover 72 which forms the wall of an atmospheric chamber 48, and the atmospheric chamber 48 is communicated with the exterior atmosphere merely via the orifice assembly 74. A housing 76 of the orifice assembly 74 formes an inner space, and the housing 76 includes two inner and outer communication ports 78 and 80 by way of which the interior of the floatless carburetor is communicated with the exterior. A partition wall 82 is disposed in the housing 76 to separate one inner and outer communication port 78 from the other inner outer communication port 82. The partition wall 82 includes a orifice 84 in the form of a fine communication hole and a communication hole 86 having a diameter larger than that of the orifice 84. A check valve 88 is disposed at the position assumed by the communication hole 86 for opening and closing the communication hole 86.

The check valve 88 is adapted to open and close the communication hole 86 depending on the differential pressure between the pressure in the atmospheric chamber 48 and the atmospheric pressure. Specifically, when the pressure in the atmospheric chamber 48 becomes higher than the atmospheric pressure, the communication hole 86 is closed, and when the pressure in the atmospheric chamber 48 is equal to or less than the atmospheric pressure, the communication hole 86 is opened.

Plural orifice assemblies 74 each having a different size of the housing 76, a different diameter of the orifice 84 and a different diameter of the communication hole 86 are provided in consideration of practical use so that a desired orifice assembly can be attached or detached to the cover 72. While the orifice assembly 74 is attached to the cover 72, the inner and outer communication port 78 of the housing 76 is communicated with the atmospheric chamber 48 and the inner and outer communication port 80 is communicated with the atmosphere. O-rings 90 and 92 are disposed at joint portions between the housing 76 and the cover 72 so as to prevent the atmosphere from being introduced via the joint portions.

Next, a mode of operation of the floatless carburetor of the present invention will be described below.

In a normal state having no turn of the personal water craft, the check valve 88 opens the communication hole 86 so that the atmospheric chamber 48 is communicated with the atmosphere via the communication hole 86 and the orifice 84. In the case that the personal water craft quickly turn, e.g., in the leftward direction, the gravity force is exerted on the fuel stored in the fuel regulating chamber 38 in the transverse direction, causing the main diaphragm 36 to be thrusted toward the atmospheric chamber 48 side. At this time, the main diaphragm 36 starts to move in such a direction that the volume of the atmospheric chamber 48 is reduced, and when a small volume of the atmospheric chamber 48 is reduced, the pressure in the atmospheric chamber 48 becomes higher than the atmospheric pressure, causing the check valve 86 to close the communication hole 86.

In such manner, since a quantity of air in the atmospheric chamber 48 is not reduced any more, the main diaphragm 36 hardly moves toward the atmospheric chamber 48 side even through the main diaphragm 36 is thrusted toward the atmospheric chamber 48 side with the fuel stored in the fuel adjusting chamber 38. Thus, it is obstructed that the arm 42 turns in such a direction that it closes the valve seat of the needle valve 34 even though the arm 42 is biased by the spring 46. As a result, the operative state that fuel is introduced into the fuel regulating chamber 38 from the position of the needle valve 34 is maintained.

Since the atmospheric chamber 48 is normally communicated with the atmosphere via the orifice 84, in the case that the pressure in the atmospheric chamber 48 is raised up, it slightly releases the pressure in the atmospheric chamber 48 via the orifice 84 so that the pressure in the atmospheric chamber 48 is gradually lowered to reach the atmospheric pressure.

As described above, with the floatless carburetor of the present invention, since the air chamber as defined by the diaphragm assumes high pressure owing to the function of the orifice assembly at the time of quick turn of the personal water craft or the like, the convectional force which is effective for closing the needle valve for regulating a quantity of fuel to be introduced into the fuel regulating chamber can be eliminated. Therefore, since a sufficient quantity of fuel can be introduced into the fuel regulating chamber at the time of quick turn of the personal water craft or the like, sufficient acceleration properties can be maintained also at the time of acceleration after completion of the quick turn.

In addition, according to the present invention, the orifice assembly is constructed separately from the cover. Thus, many kinds of optimum orifice assemblies can be prepared corresponding to a user's need, whereby acceleration properties at the time of acceleration after completion of the quick turn of the personal water craft or the like can be maintained regardless of a type of the floatless carburetor.

While the present invention has been described above with respect to a single preferred embodiment there, it should of course be understood that various change or modification may be made without departure from the scope of the invention as defined by the appended claim.

What is claimed is:

1. In a floatless carburetor including a fuel regulating chamber defined by a main diaphragm and an atmospheric chamber leading to the atmosphere for feeding fuel in a suction passage via said fuel regulating chamber by delivering fuel to said fuel regulating chamber by pumping means, the improvement wherein said floatless carburetor includes an orifice having a small diameter and an opening/closing communication hole having a diameter larger than that of said orifice between said atmospheric chamber and the atmosphere in the parallel relationship, and moreover includes a check valve adapted to close said communication hole when the pressure in the atmospheric chamber becomes higher than the atmospheric pressure.

2. The floatless carburetor as claimed in claim 1, wherein said floatless carburetor includes an orifice assembly detachably attached to a cover serving as a wall surface of said atmospheric chamber, said orifice assembly including two inner and outer communication ports for making communication between the interior and the exterior of a housing thereof and a partition wall in said housing for separating said two inner and outer communication ports from each other.

3. The floatless carburetor as claimed in claim 2, wherein when said orifice assembly is attached to said cover, one of said two inner and, outer communication ports is communicated with said atmospheric chamber, and the other inner and outer communication port is communicated with the atmosphere.

4. The floatless carburetor as claimed in claim 2, wherein said orifice and said communication hole are formed through said partition wall, and said check valve is disposed in said communication hole to open and close the latter.

* * * * *